US005460514A

United States Patent [19]

Toyoshima et al.

[11] Patent Number: 5,460,514

[45] Date of Patent: Oct. 24, 1995

[54] BURNER FOR BURNING LIQUID FUEL

[75] Inventors: Mashuaki Toyoshima, Niigata; Masashi Sato, Niitsu; Matsue Sato, Urawa, all of Japan

[73] Assignees: Nippon Oil Company Ltd.; Petroleum Energy Center Foundation, both of Japan

[21] Appl. No.: 178,556

[22] Filed: Jan. 6, 1994

[30] Foreign Application Priority Data

Jan. 13, 1993 [JP] Japan ..... 5-004293

[51] Int. Cl.[6] ..... F23D 11/00

[52] U.S. Cl. ..... 431/183; 431/265; 431/9; 431/187; 431/182

[58] Field of Search ..... 431/8, 9, 10, 350, 431/351, 353, 265, 349, 181, 182–183, 184, 187

[56] References Cited

U.S. PATENT DOCUMENTS

| | | | |
|---|---|---|---|
| 3,904,349 | 9/1975 | Peterson et al. | 431/184 |
| 3,918,886 | 11/1975 | Runninger | 431/184 |
| 4,602,571 | 7/1986 | Chadshay | 431/182 X |
| 5,192,204 | 3/1993 | Musil | 431/184 X |

FOREIGN PATENT DOCUMENTS

| | | | |
|---|---|---|---|
| 2059020 | 6/1971 | Germany | 431/183 |
| 2317513 | 10/1974 | Germany | 431/181 |

*Primary Examiner*—Carl D. Price

*Attorney, Agent, or Firm*—Finnegan, Henderson, Farabow, Garrett & Dunner

[57] ABSTRACT

Combustion air is supplied being divided into inner and outer cylinders of a main burner body, and liquid fuel is injected and burnt by a liquid fuel injection nozzle provided in the inner cylinder, wherein a tip end injection hole of the nozzle faces outside of the nozzle through a fore end opening of the inner cylinder. An annular flame piloting baffle plate for the inner cylinder is provided in front of the injection hole of the tip end opening of the inner cylinder, a swirler is provided inside of a tip end portion of the outer cylinder, and an annular flame piloting baffle plate is provided at a tip end opening portion of a cylindrical space formed between the outer and inner cylinders. Due to the foregoing construction, flames of the burner for burning liquid fuel are stabilized and an amount of generated NOx gas is reduced.

6 Claims, 7 Drawing Sheets

BURNER FOR BURNING LIQUID FUEL

BACKGROUND OF THE INVENTION (1) Field of the Invention

The present invention relates to a burner for burning liquid fuel used for a small installation for combustion such as a small boiler for business use, and more particularly relates to what is called a low NOx gas burner by which a small amount of nitrogen oxide (NOx) is generated.

(2) Related Art of the Invention

Recently, from the viewpoint of environmental preservation, it is strongly desired to reduce an amount of NOx gas generated by various combustion apparatus such as medium and large boilers and industrial furnaces, and also generated by small installations for combustion such as small boilers for business use. Therefore, it is urgent to reduce an amount of NOx gas generated by combustion apparatus.

Especially, in the case of a small installation for combustion such as a small boiler for business use in which liquid fuel is burnt, the load of a combustion chamber is heavy, so that the combustion condition is severe. As a result, an amount of NOx gas generated by the installation for combustion tends to be increased.

Conventionally, in order to reduce an amount of NOx gas generated by combustion apparatus, the following methods are employed: a recirculation method in which a portion of exhaust gas is returned to a combustion section and burnt again so as to lower the combustion temperature; a two-step combustion method in which fuel is burnt in two steps; and a method in which a normal burner is changed to what is called a low NOx gas burner by which a small amount of NOx gas is generated.

By this low NOx gas burner, the combustion temperature is lowered, so that the generation of thermal NOx gas can be suppressed. For example, the following low NOx gas burners are provided: a burner in which fuel injection ports are located distant from each other and flames are located at distant portions, so that the flame temperature can be lowered; a burner by which fuel is slowly burnt when combustion air is supplied by two steps; and a burner by which fuel is injected stepwise so that fuel-rich flames and fuel-lean flames are formed.

According to the above method of gas recirculation and that of two-step combustion, an amount of NOx gas can be effectively reduced. However, the above methods are disadvantageous in that the cost is increased when the apparatus for adopting the methods is modified or extended.

Further, in the case of a small installation for combustion, problems are caused to ensure a space where the apparatus is installed.

On the other hand, according to the above method in which the burner is changed to a low NOx gas burner, problems are not caused in the cost and space. Therefore, it is most preferable to employ the above method in which the burner is changed to a low NOx gas burner. However, in the case of a burner for burning liquid fuel, there is not provided a burner which can reduce an amount of NOx gas to a regulation value only by its own function. In almost all cases, it is necessary to provide not only a low NOx burner but also a secondary installation for reducing an amount of NOx gas, for example, an installation in which NOx gas is removed with ammonia, an installation in which the combustion temperature is lowered with a catalyst, and the like are required. In the case of a conventional low NOx gas burner, the aforementioned slow combustion or thick and thin fuel combustion is conducted. Therefore, the flame area is increased or the flame length is extended. Accordingly, it is difficult to apply the conventional low NOx gas burners to small boilers and other.

Due to the above problems, under the present conditions, satisfactory countermeasures are not taken so as to reduce an amount of NOx gas in a small installation for combustion such as a small boiler.

SUMMARY OF THE INVENTION

In view of the above conventional problems, the present invention has been achieved. It is an object of the present invention to provide a burner for burning liquid fuel by which flames can be stabilized.

Also, it is another object of the present invention to provide a burner for burning liquid fuel by which combustion is slowly conducted while the flame temperature and the excess oxygen concentration are low as a whole, so that an amount of generation of thermal NOx gas can be reduced and an inversion ratio of nitrogen contained in liquid fuel to fuel NOx can be also reduced.

It is still another object of the present invention to provide a burner for burning liquid fuel by which combustion is stabilized so that the efficiency of an installation for combustion can be improved.

In order to accomplish the above objects, the present invention is to provide a burner for burning liquid fuel, comprising: a main burner body having a double cylindrical portion composed of inner and outer cylinders; a liquid fuel injection nozzle disposed in the inner cylinder of the main burner body, a tip end nozzle hole of the liquid fuel injection nozzle facing the outside through an opening portion of a tip end of the inner cylinder; and an air blasting means for supplying combustion air, wherein the combustion air supplied by the air blasting means is divided by a flow dividing means into primary air to flow in to the inner cylinder and secondary air to flow in to the outer cylinder, and mixture gas containing liquid fuel injected by the liquid fuel injection nozzle and combustion air is ignited by an ignition means.

The burner for burning liquid fuel further comprises: an annular flame piloting baffle plate for the inner cylinder disposed at a front position of the nozzle hole of the fore end opening portion of the inner cylinder, the annular flame piloting baffle plate covering an outer periphery of the opening portion surface; a swirler disposed inside of a tip end of the outer cylinder, the swirler having a large number of fins approximately spirally curved so as to generate a swirling flow in the secondary air, the fins being successively disposed in a circumferential direction; and an annular flame piloting baffle plate for the outer cylinder disposed at a fore end opening portion of a cylindrical space formed between the outer and inner cylinders, the annular flame piloting baffle plate annularly covering an inner circumferential portion of the tip end opening portion.

Due to the foregoing, blasting air generated by the blasting means is supplied as combustion air and divided by the flow dividing means into the inner and outer cylinders while an amount of divided air is appropriately adjusted. On the other hand, liquid fuel is atomized by the fuel injection nozzle and mixed with the primary air supplied to the inner cylinder. Then the mixture is ignited by the ignition means so as to start fuel combustion. By the action of the flame piloting baffle plate provided on the inner cylinder side, the liquid fuel atomized by the fuel injection nozzle and the primary air are uniformly mixed, and a stable flame is formed.

The fuel which has not been burnt in the inner cylinder is mixed with the secondary air supplied by the outer cylinder, wherein the secondary air is swirled by the action of the swirler. The flame on the outer cylinder side is formed to be held by the action of the flame piloting baffle plate provided on the outer cylinder side, and surrounds the flame of the inner cylinder.

An amount of combustion air divided into the inner cylinder, that is, an amount of primary air is preferably controlled to be 5 to 20% of the entire amount of combustion air, and more preferably 8 to 15%.

When the amount of primary air supplied to the inner cylinder is extremely reduced as described above, combustion is conducted under a fuel-rich condition. Accordingly, a stable flame can be provided, that is, stable combustion is conducted under a fuel-rich condition.

Also, an injection angle of the secondary air injected from a tip end injection hole formed between adjacent fins of the swirler is preferably set at a value not less than 30° and not more than 60°.

As a result of the foregoing, the fuel which has not been burnt in the inner cylinder can be mixed with the secondary air sent from the outer cylinder which has been strongly swirled by the action of the swirler. Due to the effect of the swirling flow of secondary air, the unburnt fuel and the secondary air can be uniformly mixed, and the residence time of this mixture is shortened. Therefore, a non-luminous flame, the length of which is short, can be formed under the condition of fuel-lean. This non-luminous flame is formed to be stabilized by the action of a flame piloting baffle plate provided outside the outer cylinder, and to surround a flame generated by the fuel-rich combustion in the inner cylinder.

As a result of the foregoing, combustion is slowly conducted under the condition that the flame temperature and excess oxygen concentration are low as a whole. Accordingly, an amount of generation of thermal NOx gas can be reduced, and a conversion ratio of nitrogen contained in liquid fuel to fuel NOx can be lowered.

Further, it is preferable that the entire air ratio is set at 1.1 to 2.0, and it is more preferable that the entire air ratio is set at 1.1 to 1.3.

Due to the foregoing, the combustion can be stabilized, and the efficiency of an installation for combustion can be improved.

With reference to an embodiment shown in the accompanying drawings, the present invention will be explained in detail as follow. However, it should be noted that the present invention is not limited to the specific embodiment, and that variations, modifications and elimination may be made within the scope of the appended claims.

DETAILED DESCRIPTION OF THE PREFERRED EMBODIMENTS

Figure 1:
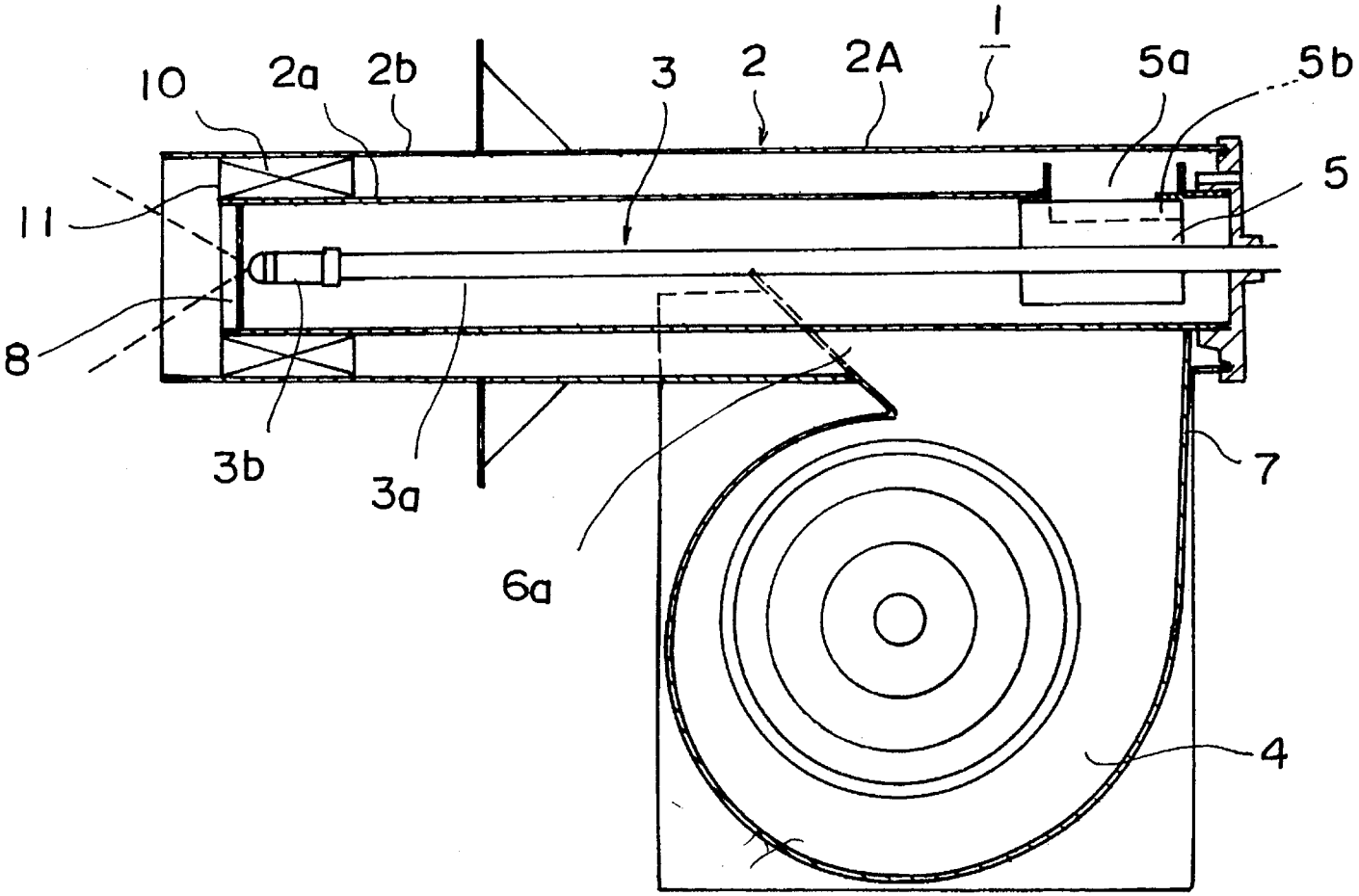
FIG. 1 is a sectional view showing the overall arrangement of an embodiment of a burner for burning liquid fuel according to the present invention.
Figure 2:
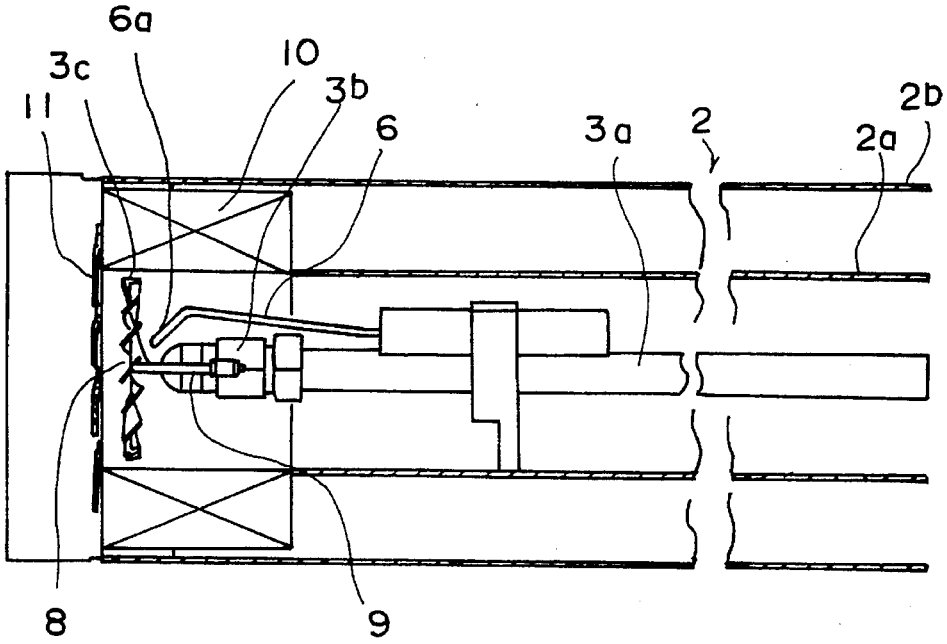
FIG. 2 is a partially enlarged sectional view of the above embodiment.
Figure 3:
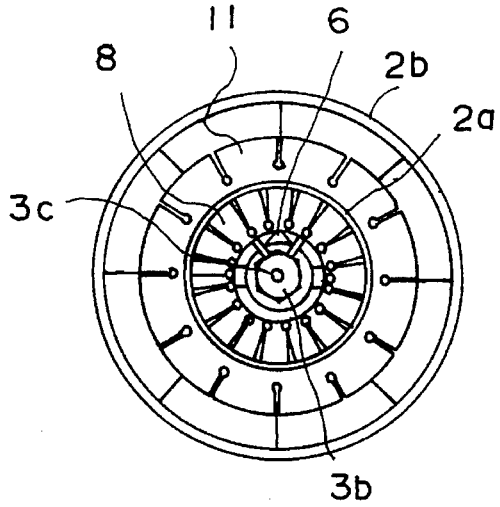
FIG. 3 is an end surface view of FIG. 2.

With reference to FIGS. 1 and 2, the construction of a burner for burning liquid fuel will be briefly explained as follows. A burner 1 includes a main burner body 2, a nozzle 3 for injecting liquid fuel, a blower 4 used as an air blasting means for supplying air for combustion, a damper 5 used as a flow dividing means for dividing combustion air supplied by the blower 4, and an ignition plug 6 used as an igniting means.

In this case, the main burner body 2 is provided with a double cylindrical portion 2A composed of an inner cylinder 2*a* and an outer cylinder 2*b* which are coaxially disposed. A tip end surface of this double cylindrical portion 2A is opened, and a rear end surface is closed.

A box-shaped wind box portion 7 communicated only with the inside of the outer cylinder 2*b* is integrally formed on an outer peripheral surface of the rear end portion of the double cylindrical portion 2A.

The liquid fuel injection nozzle 3 is composed of a rod-shaped cylindrical nozzle adapter 3*a*,and a nozzle formation member 3*b* connected with a tip end portion of the nozzle adapter 3*a*. An injection hole 3*c* is formed at a tip end portion of the nozzle formation member 3*b*.

The liquid fuel injection nozzle 3 described above is disposed inside the inner cylinder 2*a* along a central axis of the inner cylinder 2*a*. The tip end injection hole 3*c* of the nozzle formation member 3*b* is disposed in such a manner that the tip end injection hole 3*c* faces the outside through the tip end opening portion of the inner cylinder 2*a*.

The damper 5 is a variable damper capable of adjusting an amount of air for combustion supplied under the condition that the air is divided into the inner and outer cylinders 2*a*, 2*b*. This variable damper 5 is disposed inside the rear end portion of the inner cylinder 2*a*, and an inlet 5*a* for combustion air is opened to the inside of the outer cylinder 2*b*. This inlet 5*a* is provided with a variable shutter 5*b* which varies an opening area of the inlet 5*a*. In this way, an amount of air for combustion which flows from the inlet 5*a* to the inner cylinder 2*a*can be adjusted. The ignition plug 6 is fixed to the outer periphery of the nozzle adapter 3*a* of the fuel injection nozzle 3, and a tip end igniting portion 6*a* of the ignition plug 6 is located at a position close to the tip end injection hole 3*c* of the nozzle formation member 3*b* of the fuel injection nozzle 3.

In this case, in a tip end opening portion of the inner cylinder 2*a*, there is provided an annular flame piloting baffle plate 8 for the inner cylinder, and the annular flame piloting baffle plate 8 annularly covers an outer periphery end portion of the opening surface.

Figure 4:
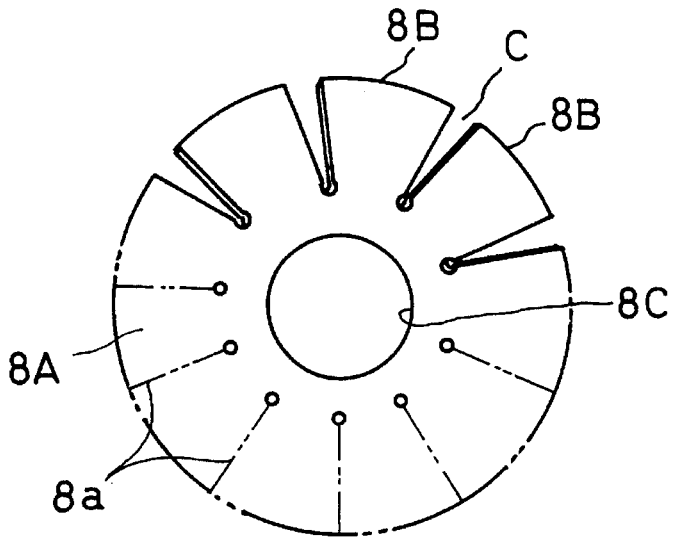
FIG. 4 is a perspective view showing the structure of a flame piloting baffle plate in the above embodiment.

As shown in FIG. 4, this flame piloting baffle plate 8 for the inner cylinder is constructed as described below.

In an annular plate member 8A, a large number of grooves 8*a* of a predetermined length are formed in such a manner that the grooves 8*a* extend to the center of the annular plate member 8A from positions located on the circumference of the annular plate member 8A at regular intervals. Then, portions of the annular plate member 8A located between the grooves 8*a* are diagonally raised in order, so that a large number of fins 8B are formed. In this case, gaps c are provided between the adjacent fins 8B.

Mixture is blown out through the gaps c formed between the adjacent fins 8B. After that, the mixture is returned through the gaps c in the case of this flame piloting baffle plate 8. That is, a mixture recirculating action is effected by this flame piloting baffle plate 8, so that the flames can be stabilized.

The injection hole 3*c* of the nozzle 3 faces a central opening portion 8C of the flame piloting baffle plate 8 for the inner cylinder.

This flame piloting baffle plate 8 for the inner cylinder is supported by the fuel injection nozzle 3 through a stay 9.

A swirler 10 to swirl the secondary air supplied to the outer cylinder 2*b* is disposed inside the tip end portion of the outer cylinder 2*b*.

Figure 5:
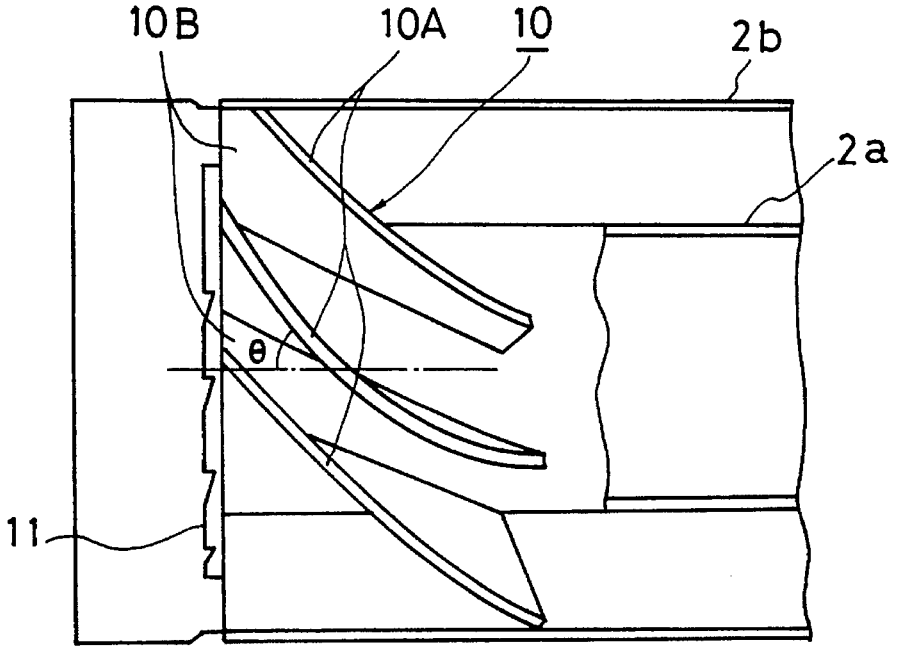
FIG. 5 is a partially enlarged view showing the structure of a swirler in the above embodiment.

As shown in FIG. 5, the swirler 10 is constructed a described below.

A large number of approximately spirally curved fins 10A are disposed on the outer periphery surface of the tip end portion of the inner cylinder 2*a* in the circumferential direction. In this case, the spirally curved fins 10A are fixed to the outer periphery surface by means of welding, and the secondary air is injected from a tip end injection hole 10B formed between the adjacent fins 10A.

An annular flame piloting baffle plate 11 for the outer cylinder is disposed at a fore end opening portion of a cylindrical space between the outer and inner cylinders 2*b* , 2*a*, so that the annular flame piloting baffle plate 11 annularly covers an inner circumferential portion of the opening surface of the tip end opening surface.

This flame piloting baffle plate 11 for the outer cylinder is constructed as follows in the same manner as that of the flame piloting baffle plate 8 for the inner cylinder.

In an annular plate member, a large number of grooves of a predetermined length are formed in such a manner that the grooves extend to the center of the annular plate member from positions located on the circumference of the annular plate member at regular intervals. Then, portions of the annular plate member located between the grooves are diagonally raised in order, so that a large number of fins are formed. In this case, gaps are provided between the adjacent fins.

Mixture is blown out through the gaps formed between the adjacent fins in the case of this flame piloting baffle plate 11. After that, the mixture is returned through the gaps. That is, a mixture recirculating action is effected by this flame piloting baffle plate 11, so that the flames can be stabilized.

This flame piloting baffle plate 11 for the outer cylinder is fixed to the tip end portion of the inner cylinder 2*a* by means of welding.

Next, the operation of the burner 1 constructed in the manner described above will be explained as follows.

A blast of wind generated by the blower 4 is sent to the window box portion 7 so as to be used as combustion air.

A flow of the combustion air sent to the window box portion 7 is divided into the inner and outer cylinders 2*a*, 2*b* by the variable damper 5. In this case, an amount of combustion air divided into the inner cylinder 2*a*, that is an amount of primary air is determined to be 5 to 20% of an entire amount of the combustion air. On the other hand, liquid fuel is fed with pressure to the nozzle adapter 3*a* of the fuel injection nozzle 3, and atomized by the tip end injection hole 3*c* of the nozzle member 3*b*. The atomized liquid fuel is mixed with the primary air supplied to the inner cylinder 2*a*. Then, the mixture is ignited by the ignition plug 6. In this way, combustion starts. By the action of the flame piloting baffle plate 8 provided on the inner cylinder 2*a* side, the liquid fuel atomized by the tip end injection hole 3*c* is uniformly mixed with the primary air, so that stable flames can be formed. In this case, an amount of the primary air supplied to the inner cylinder 2*a* is extremely reduced. Therefore, combustion is conducted under a fuel-rich condition. Accordingly, the flames are stabilized as described above in the fuel-rich combustion.

A portion of fuel which has not been burnt in the inner cylinder 2*a* is mixed with the secondary air sent from the outer cylinder 2*b* to which a strong swirling action is given by the swirler 10, the injection angle of which is not less than 35°. In this case, the injection angle is defined as an angle θ by which the secondary air is injected from the tip end injection hole 10B formed between the adjacent fins 10A of the swirler 10 as shown in FIG. 5. At this time, by the strong swirling action of the secondary air, the unburnt fuel and the secondary air are uniformly mixed, and the residence time of this mixture is shortened. Therefore, a non-luminous flame, the length of which is short, can be formed under a fuel-lean condition. This non-luminous flame is formed to be stabilized by the action of a flame piloting baffle plate 11 provided outside the outer cylinder 2*b* side, and surround a flame generated in the fuel-rich combustion in the inner cylinder 2*a*.

As a result of the foregoing, combustion is slowly conducted under the condition that the flame temperature and excess oxygen concentration are low as a whole. Accordingly, an amount of generation of thermal NOx gas can be reduced, and a conversion ratio of nitrogen to fuel NOx can be lowered.

Since the unburnt fuel and the secondary air are uniformly mixed and further the residence time is short, the length of flames is shortened. Accordingly, this burner is advantageously applied to small installation for combustion having a small combustion chamber.

In the case of the burner 1 constructed in the manner described above, the inventors have found the following through experiments.

Figure 7:
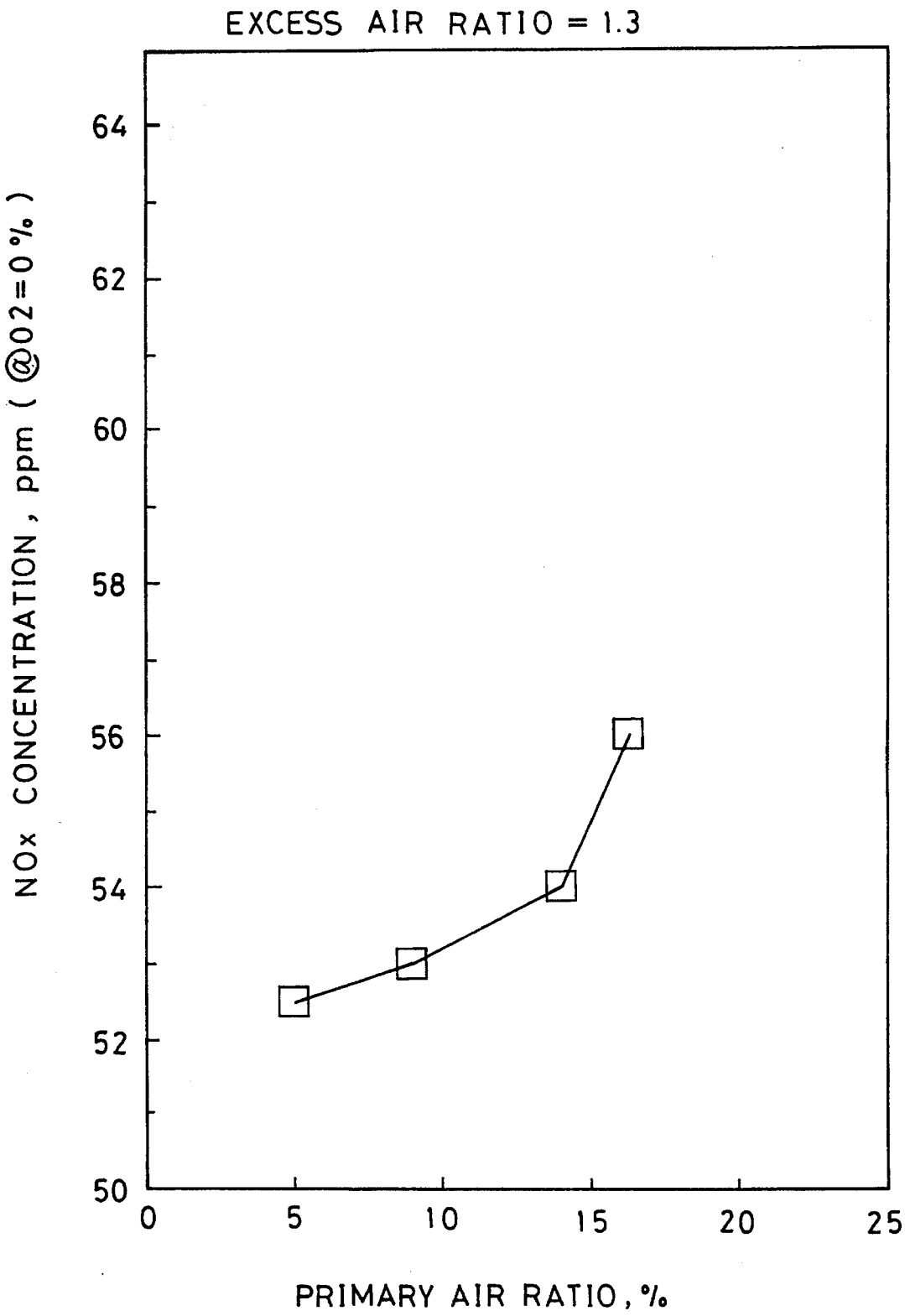
FIG. 7 is a graph showing the experimental result of the burner for burning liquid fuel of the present invention, which shows the relation between the primary air ratio and NOx concentration.

When an amount of the primary air exceeds 20% of an amount of the entire air, the flame temperature and oxygen concentration are increased in a fuel-rich combustion region. Accordingly, an amount of generated NOx gas rapidly is increased (refer to FIG. 7).

Figure 8:
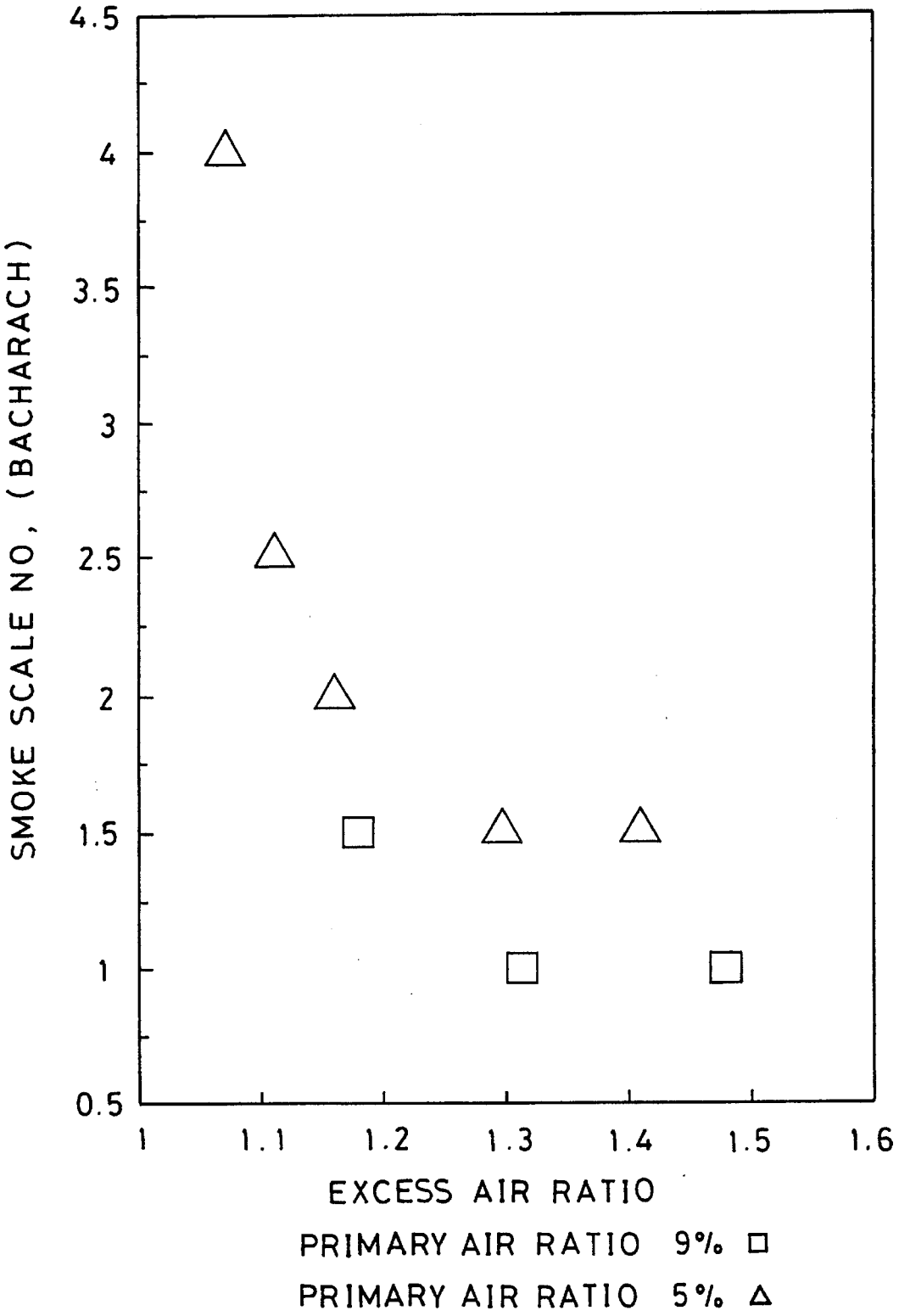
FIG. 8 is a graph showing the experimental result of the burner for burning liquid fuel of the present invention, which shows the relation between excess air ratio and smoke scale number.
Figure 9:
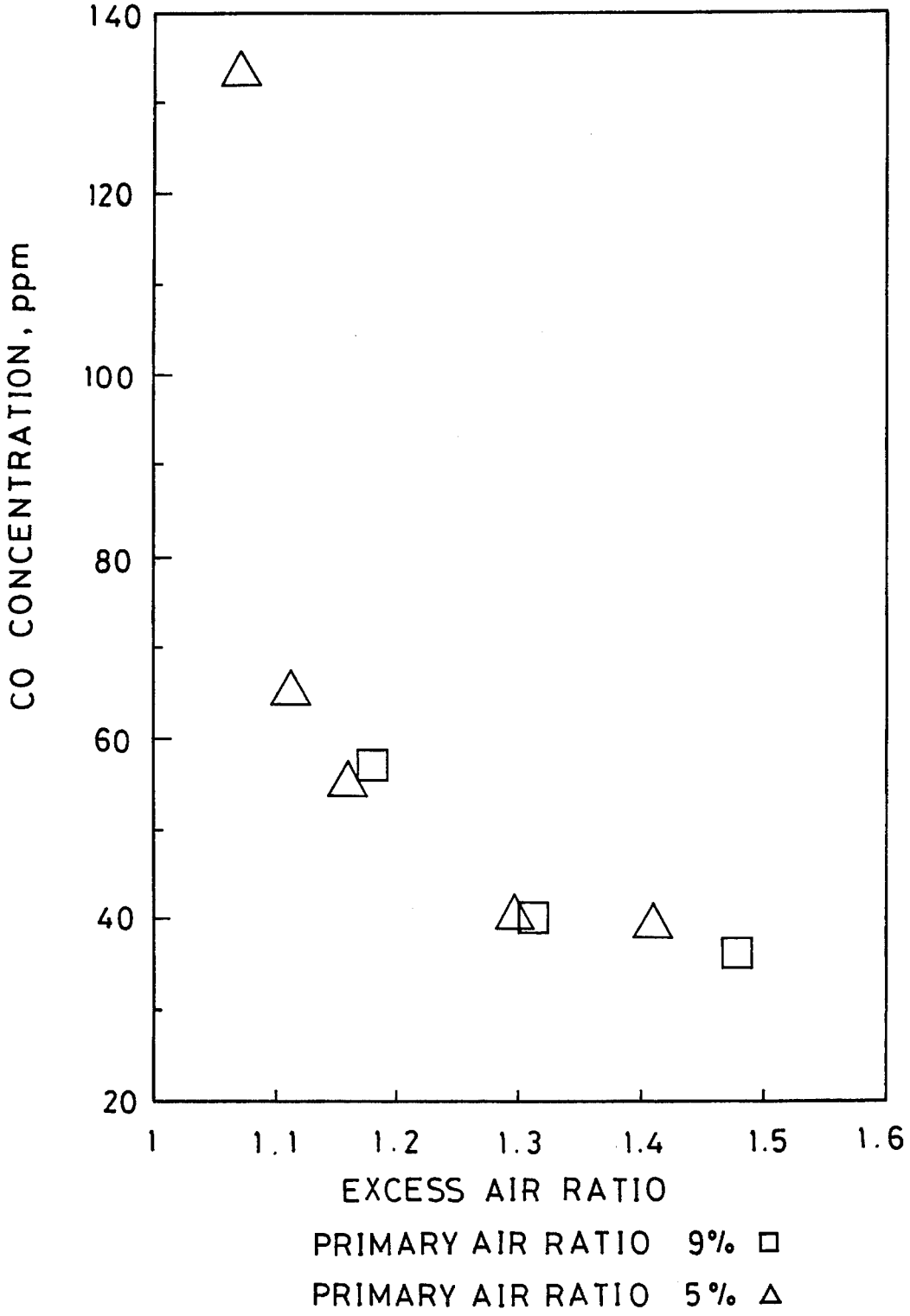
FIG. 9 is a graph showing the experimental result of the burner for burning liquid fuel of the present invention, which shows the relation between excess air ratio and CO concentration.

Further, when an amount of the primary air is less than 5% of an amount of the entire air, and amount of generated smoke dust is increased (refer to FIG. 8).

On the other hand, the flame temperature is raised in a fuel-lean combustion region, too. Therefore, an amount of generated NOx gas is increased. In the case where the injection angle of the swifter is smaller than 30°, a sufficient swirling action is not given to the secondary air, so that the fuel which has not been burnt in the inner cylinder 2*a* and the secondary air supplied by the outer cylinder 2*b* are not sufficiently mixed, and unstable long flames are formed and a high temperature portion is locally generated and further incomplete combustion is caused. As a result, amounts of NOx, CO and smoke dust are increased. Even when the injection angle of the swirler 10 exceeds 60°, a vortex is generated close to the burner 1. Therefore, the fuel which has not been burnt in the inner cylinder 2*a* and the secondary air sent form the outer cylinder 2*b* are not sufficiently mixed. As a result, the amount of generated NOx gas is increased.

When the entire air ratio becomes smaller than 1.1, smoke dust tends to be generated (refer to FIG. 8) and incomplete combustion tends to occur. As a result, the amount of generated CO is increased (refer to FIG. 8).

On the other hand, when the air ratio exceeds 2.0, combustion becomes unstable, so that the efficiency of an installation for combustion is lowered.

Further, in the case where the flame piloting baffle plates 8, 11 of the inner and outer cylinders 2*a*, 2*b* are not provided, flames become unstable. Especially, flames tend to blow away from the outer cylinder.

Consequently, the inventors have found that the flames are maintained stable and an amount of NOx gas is effectively reduced under the following condition: an amount of the primary air is 5 to 20% of the entire air amount, and preferably 8 to 15%; an entire air ratio is 1.1 to 2.0, and preferably 1.1 to 1.3.

Also, the inventors have found the following: under the condition that an injection angle of the swirler 10 is not less than 30° and not more than 60°, the fuel which has not been burnt in the inner cylinder 2*a* and the secondary air sent from the outer cylinder 2*b* are uniformly mixed and stable short flames are formed, so that a high temperature portion is not locally formed and further incomplete combustion is not caused. As a result, amounts of generated NOx gas, CO gas and smoke dust can be reduced.

Further, the inventors have found the following: when the flame piloting baffle plates 8, 11 are provided between the inner and outer cylinders 2*a*, 2*b*, the flames can be stabilized, and especially the flames can be effectively prevented from blowing away from the outer cylinder 2*b*.

Figure 6:
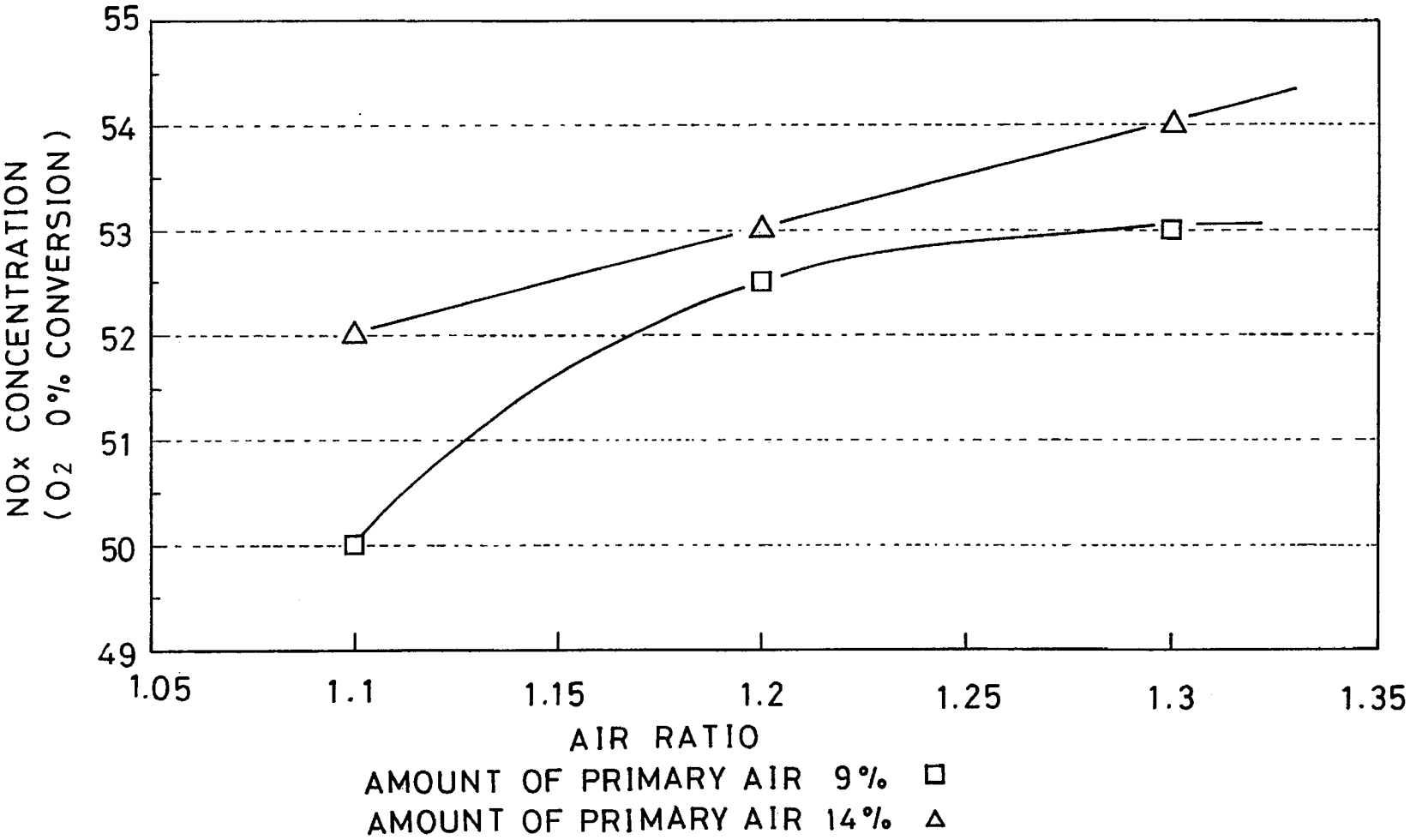
FIG. 6 is a graph showing the concentration of NOx gas in a vertical hot water pipe type boiler to which the burner for burning liquid fuel of the present invention is applied.

In this connection, FIG. 6 is a graph showing the concentration of NOx gas ($O_2$ gas 0% conversion) in the case where A-heavy oil (containing nitrogen by 200 ppm) was burnt in a vertical hot water type boiler at an air ratio of 1.1 to 1.3. In this case, an amount of the primary air was set at 9% and 14%. In both cases, an amount of NOx gas was not more than a reference value (for example, NOx gas concentration 80 ($O_2$ 0% conversion). It was found that NOx concentration was reduced in the case where an amount of the primary air was 9% as compared with a case where an amount of the primary air was 14%.

We claim:

1. A burner for burning liquid fuel, comprising:

a main burner body having generally coaxial inner and outer cylinders, said inner cylinder having a first opening at one distal end communicating via a cylindrical end space to a second opening at a corresponding distal end of said outer cylinder;

a liquid fuel injection nozzle provided in said inner cylinder of said main burner body, wherein an injection hole of said nozzle faces the first opening of said inner cylinder;

an air blasting means for supplying combustion air;

a flow dividing means for dividing the combustion air supplied by said air blasting means, wherein said flow dividing means divides the combustion air into primary air flowing into said inner cylinder and secondary air flowing into said outer cylinder;

an ignition means for igniting a mixture including liquid fuel injected by said liquid fuel injection nozzle and combustion air proximate the distal end of said inner cylinder;

flame piloting baffle plates including a first annular flame piloting baffle plate for the inner cylinder disposed in front of said injection hole proximate the first opening of said inner cylinder so that said first annular flame piloting baffle plate annularly covers an outer peripheral portion of said first opening, said first annular flame piloting baffle plate including a plurality of fins spaced about an outer periphery thereof, with gaps between said fins defining paths for recirculation of said mixture and said primary air, and also including a second annular flame piloting baffle plate for the outer cylinder disposed proximate the second opening so that said second annular flame piloting baffle plate annularly covers an inner peripheral portion of said second opening, said second annular flame piloting baffle plate including a plurality of fins spaced about an outer periphery thereof, with gaps between said fins defining paths for recirculation of said mixture and said secondary air; and a swirler provided proximate the second opening of said outer cylinder, having a plurality of generally spirally curved fins disposed circumferentially to swirl the secondary air.

2. The burner for burning liquid fuel according to claim 1, wherein a ratio of an amount of the primary air to an amount of the entire air is 5 to 20%.

3. The burner for burning liquid fuel according to claim 1, wherein an entire air ratio is set at 1.1 to 2.0.

4. The burner for burning liquid fuel according to claim 1, wherein an injection angle of the secondary air injected from a tip end injection port formed between adjacent fins of said swirler is set in a range from not less than 30° to not more than 60°.

5. The burner for burning liquid fuel according to claim 1, wherein a ratio of an amount of the primary air to an amount of the entire air is 8 to 15%.

6. The burner for burning liquid fuel according to claim 1, wherein an entire air ratio is set at 1.1 to 1.3.

* * * * *